US006349938B1

(12) United States Patent
Kubacki et al.

(10) Patent No.: US 6,349,938 B1
(45) Date of Patent: Feb. 26, 2002

(54) REJECT APPARATUS FOR USE WITH SLITTER MECHANISM

(75) Inventors: Ed Kubacki, Marengo; Robert C. Jack, Hoffman Estates; John Czarnota, Plainfield, all of IL (US)

(73) Assignee: United States Can Company, Lombard, IL (US)

( * ) Notice: Subject to any disclaimer, the term of this patent is extended or adjusted under 35 U.S.C. 154(b) by 0 days.

(21) Appl. No.: 09/563,044

(22) Filed: May 1, 2000

(51) Int. Cl.[7] ..... B65H 43/04; B07C 5/34; B26D 7/18

(52) U.S. Cl. ..... 271/302; 271/303; 83/106; 83/79; 83/404; 209/657; 209/702

(58) Field of Search ..... 271/303, 302, 271/307, 312; 198/367; 83/106, 79, 404; 209/657, 656, 702

(56) References Cited

U.S. PATENT DOCUMENTS

| | | | | |
|---|---|---|---|---|
| 1,841,426 A | * | 1/1932 | Balletti | 83/106 |
| 2,195,176 A | * | 3/1940 | Kronquest | 209/604 |
| 2,229,638 A | | 1/1941 | Chamberlin et al. | |
| 2,337,064 A | * | 12/1943 | Peters | 209/603 |
| 2,417,145 A | * | 3/1947 | Ward | 271/303 |
| 2,425,637 A | | 8/1947 | Pearson | |
| 2,576,043 A | * | 11/1951 | Rendel | 346/33 F |
| 2,617,528 A | | 11/1952 | Moore | |
| 2,793,662 A | | 5/1957 | Oholm | |
| 2,950,005 A | * | 8/1960 | MacDonald | 209/3.2 |
| 2,971,414 A | | 2/1961 | Owen | |
| 3,094,826 A | | 6/1963 | Davey et al. | |
| 3,232,607 A | * | 2/1966 | Larson | 271/303 |
| 3,518,805 A | | 7/1970 | Udal et al. | |
| 3,556,518 A | * | 1/1971 | Brockmueller | 271/303 |
| 3,861,259 A | * | 1/1975 | Hitch | 83/106 |
| 3,880,033 A | | 4/1975 | Taylor | |
| 4,530,199 A | | 7/1985 | Manservisi et al. | |
| 4,784,318 A | | 11/1988 | Bay | |
| 4,881,356 A | | 11/1989 | Beezer et al. | |
| 4,976,089 A | * | 12/1990 | Reichelt | 53/53 |
| 5,732,609 A | | 3/1998 | Marschke | |

FOREIGN PATENT DOCUMENTS

| | | |
|---|---|---|
| CA | 9986409 | 3/1976 |
| DE | 1297979 | 11/1969 |

* cited by examiner

*Primary Examiner*—Donald P. Walsh
*Assistant Examiner*—Daniel K Schlak
(74) *Attorney, Agent, or Firm*—Polster, Lieder, Woodruff & Lucchesi, L.C.

(57) ABSTRACT

A reject mechanism (10) for use with a slitter (S) which slits a printed metal sheet (B) into segments (s) subsequently used to form containers. The mechanism is mounted at the outlet of the slitter to deflect rejected segments from a collection bin (C) to which acceptable segments are delivered for further use in container manufacture. The mechanism comprises a series of pneumatically actuated reject fingers (14) normally positioned beneath a path over which the segments pass from the slitter to the collection bin. However, when a reject segment approaches the mechanism, a piston (16) is activated to extend the fingers into the path of the segment to deflect the segment off its path into another collection area in which rejected segments are collected. The fingers are then retracted so that succeeding acceptable segments pass freely over the path.

17 Claims, 4 Drawing Sheets

REJECT APPARATUS FOR USE WITH SLITTER MECHANISM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to the manufacture of containers such aerosol cans, paint cans and the like, and more particularly, to a reject apparatus for selectively discarding unacceptable can bodies after they have been routed through a slitter mechanism.

In the manufacture of cans, a rectangular sheet of steel is sized so a plurality of can bodies can be made from the sheet. In the manufacturing process, the sheet may be first run through a printing press by which a product label and other information is printed on one side of the sheet. The number of labels printed on the sheet corresponds to the number of can bodies which are formed from the sheet. After printing, the sheet is run through a slitter mechanism which first slits the sheet along one of its axes (its longitudinal axis, for example), and then along another axis (for example, crosswise along the orthogonal axis of the sheet). The resulting blanks are then carried to a welding machine where the plates are welded into cylinders used to form can bodies. Because of defects in a sheet, poor printing results, etc., it may be necessary to reject certain portions of the sheet from which can bodies would otherwise be formed.

A reject mechanism used to perform this function must solve a number of problems. For example, since the slitter mechanism is adjustable to cut sheets of different sizes, the reject mechanism must be similarly adjustable. In addition, the areas on the sheets where defects occur or where there is bad printing may vary from sheet to sheet. The reject apparatus must therefore be selectably controllable to accurately remove only the unwanted segments from each sheet, and it must be capable of doing so without effecting the high throughput capacity of the slitter apparatus.

BRIEF SUMMARY OF THE INVENTION

Among the several objects of the present invention may be noted the provision of a reject mechanism for use with a slitter apparatus to selectively remove from a stream of sheet segments produced by the slitter only those segments which are not to be used to form can bodies, and to not otherwise interfere with the movement of acceptable sheet segments from the slitter;

the provision of such a reject mechanism by which either the same segments or different segments from different sheets can be removed from the flow of segments;

the provision of such a reject mechanism whose operation does not effect the throughput rate of the slitter;

the provision of such a reject mechanism which is readily adjusted during changeovers to accommodate different size sheets passing through the slitter;

the provision of such a reject mechanism sized to fit between one end of a slitter apparatus and a collection bin in which acceptable sheet segments are collected for transfer to can forming equipment;

the provision of such a reject mechanism to include a plurality of fingers spaced across an edge of a slitter table, the fingers being reciprocally movable fingers each of which is selectively activated to move into the path of an unwanted sheet segment to deflect the segment into a reject bin or the like, the fingers moving sufficiently quickly as to move out of the path of the next acceptable sheet segment;

the provision of such a reject mechanism to be operable by the person operating the slitter; and, the provision of such a reject mechanism which is easily installed and readily removed from the slitter.

In accordance with the invention, generally stated, a reject mechanism is for use with a slitter which slits a printed metal blank into segments subsequently used to form cans for holding and dispensing fluid commodities. The mechanism is mounted at the outlet of the slitter to deflect rejected segments from a collection area to which acceptable segments are delivered for further use in can manufacture. The mechanism comprises a series of pneumatically actuated fingers normally positioned beneath a path over which the segments pass from the slitter to the collection area. However, when a reject segment approaches the mechanism, a piston is activated to elevate the fingers into the path of the segment to deflect the segment off its path into a second collection area in which rejected segments are collected. The fingers are then retracted so that succeeding acceptable segments pass freely over the path. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
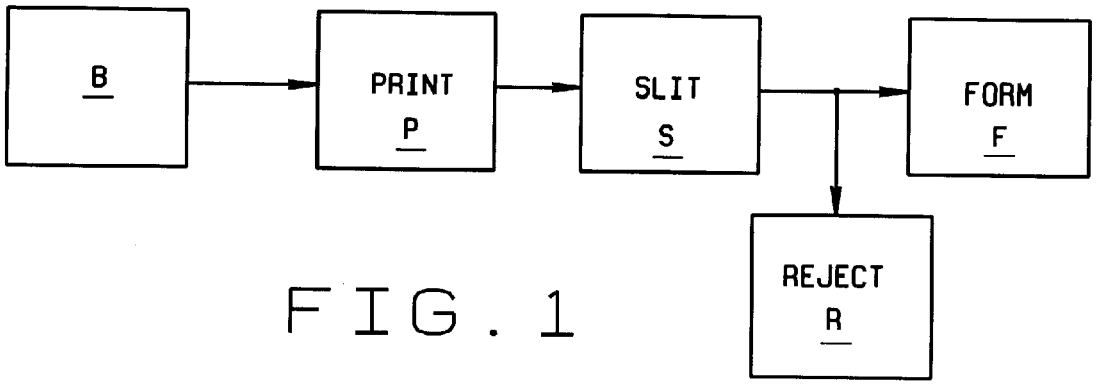
FIG. 1 is a simplified block diagram of a forming operation for containers.

Referring to the drawings, FIG. 1 illustrates the manufacturing process for containers such as aerosol cans, paint cans, and the like. As shown in the drawing, a plain blank B of a desired size and thickness is first routed through a print station P for labels and other information to be printed on one side of the sheet. The printing is repeated both across and along the sheet since numerous containers will be formed from the single sheet. After printing, the sheet is routed to a slitter mechanism S where the sheet is cut into a plurality of segments each of which is used to form a separate container. Finally, and as previously described above, the segments are routed to a forming line F where the cans are formed. Or, if the blanks are unacceptable, they are rejected as indicated at R and not used.

Figure 2:
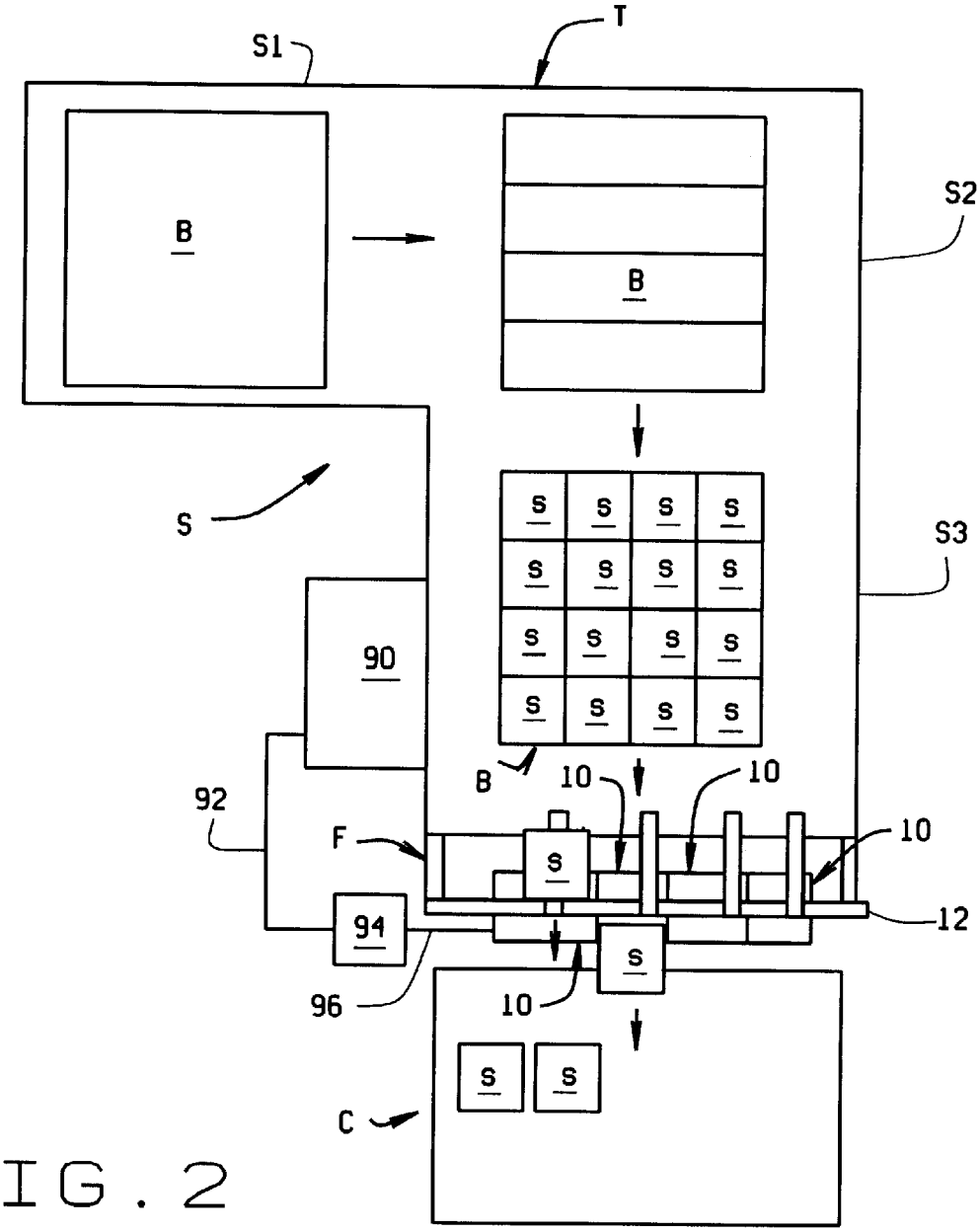
FIG. 2 is a simplified plan view of a slitter mechanism forming multiple can segments from a printed blank.

As shown in FIG. 2, after printing, blanks B are placed on a slitter table T where the blank is cut into segments. The slitting operation generally comprises three stages S1–S3. At stage S1, printed tin plate thin sheets B (approx. 36" wide by 32" long) are placed on the table. As the blank then moves along the table, a series of top and bottom rotation slitter cutters, X and Y respectively, cut the sheet in one direction along the sheet (stage S2). This produces a series of strips which are then cut crosswise with respect to the first cuts (at stage S3) to produce the individual segments s from which containers are made. At stage S3, the cuts are again made by a series of top and bottom rotation slitter cutters X and Y. The cutters turn the continuous sheet into the numerous smaller rectangular segments s (for example, four rectangular segments each of which is 9"×8"). It will be understood by those skilled in the art that the slitter mechanism can accommodate blanks of different sizes and that the size of the resulting segments also can vary. After the second series of cuts are made, the segments are pushed off the end of the table and fall into collection bin C. In doing so, the segments pass over a reject mechanism 10 of the present invention. As described hereinafter, mechanism 10 is selectively operable to deflect "bad" or unacceptable segments from bin C and direct these rejected segments into another bin (not shown) so that these segments will not be used in forming containers. The slitter and its operation form no part of this invention.

Figure 3:
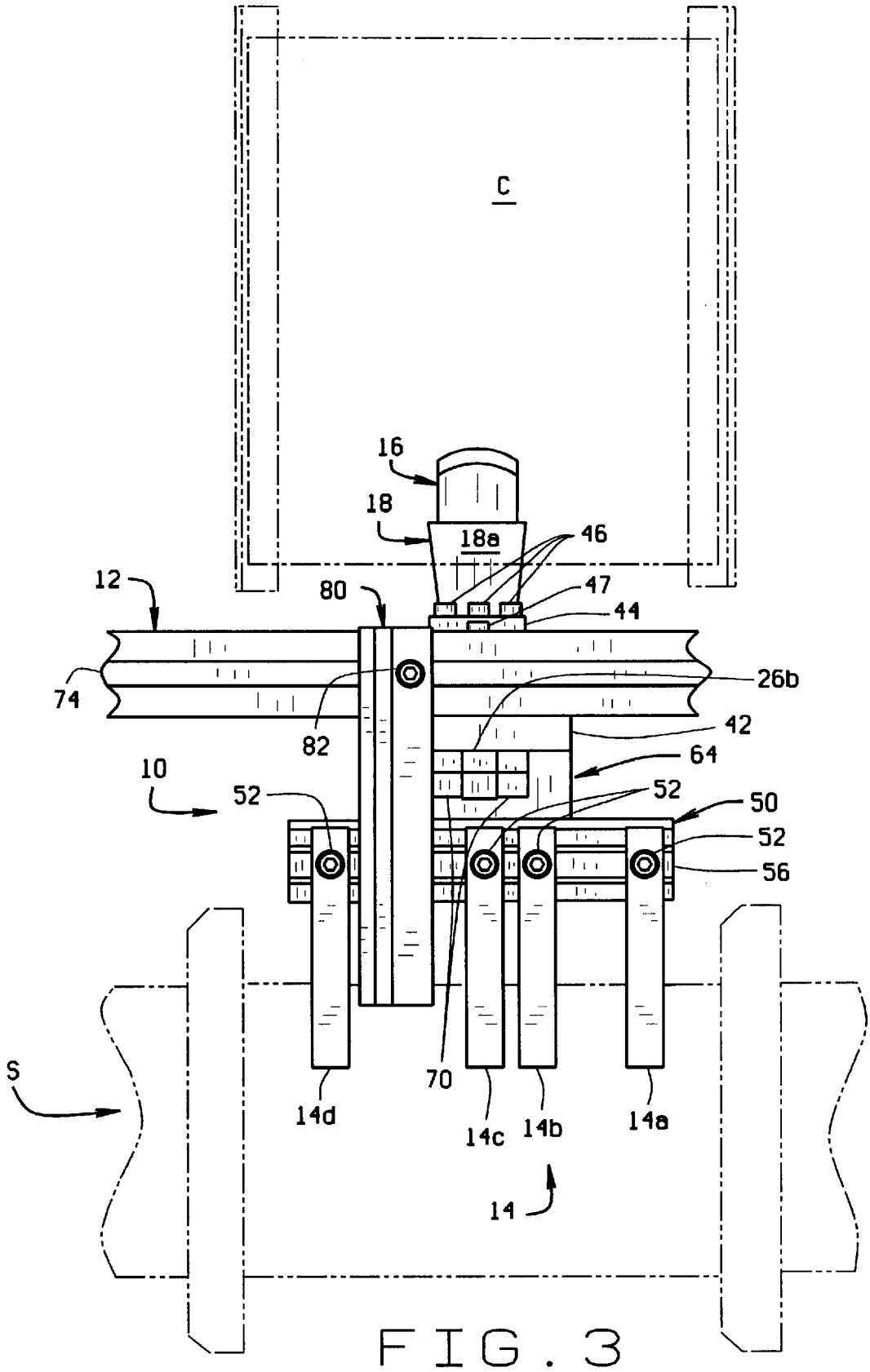
FIG. 3 is a top plan view of a slitter reject mechanism of the present invention.
Figure 4:
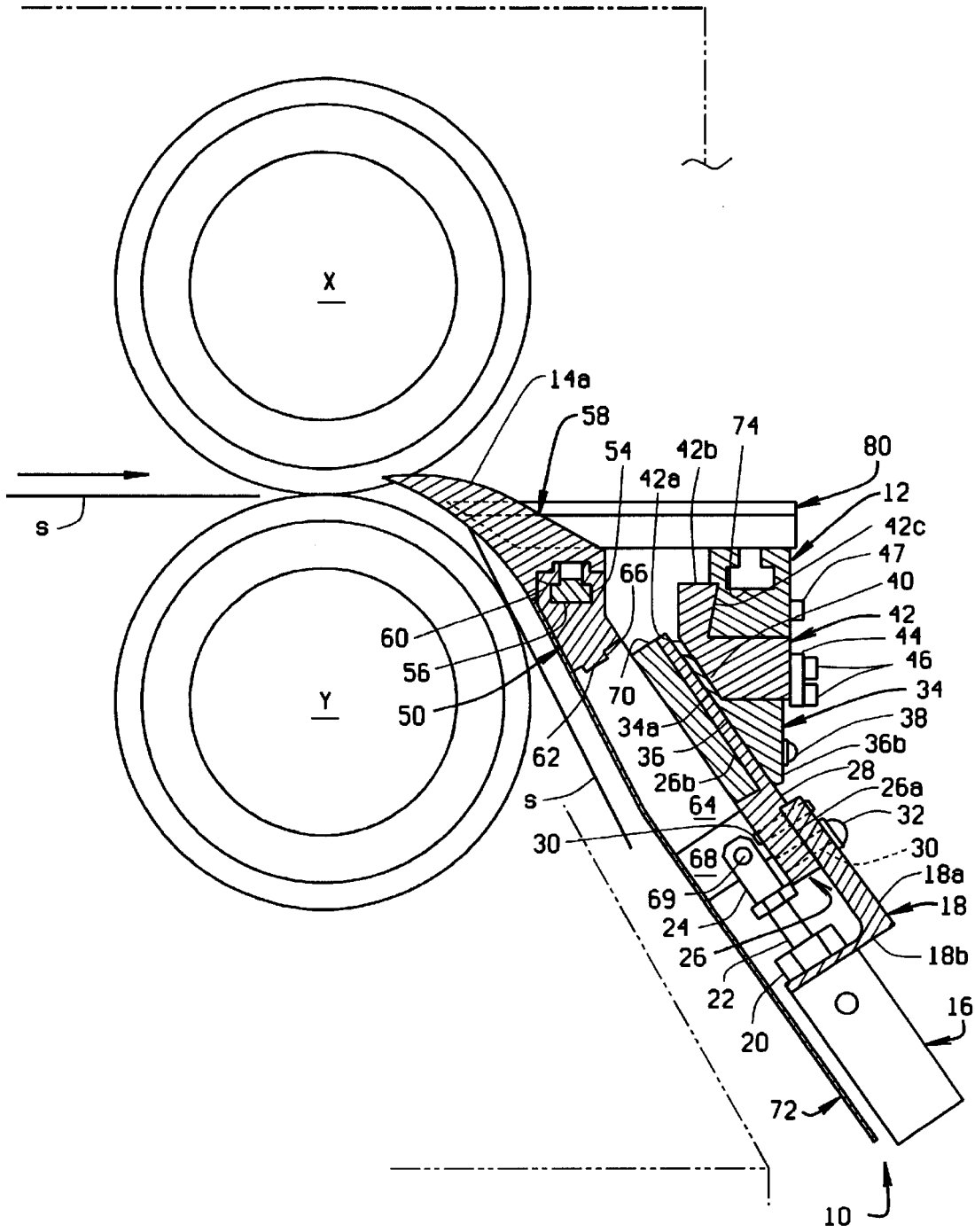
FIG. 4 is a side elevational view, partly in section, of the slitter reject mechanism; and, FIG. 5 is a side elevational view of a second embodiment of the slitter reject mechanism.

Referring to FIGS. 3 and 4, a support bar 12 extends between the output end of slitter mechanism S and collection bin C. Reject mechanism 10 is mounted on this support bar. The support bar extends across the entire width of the slitter mechanism. Since as shown in FIG. 2, segments formed from the blank extend across the width of the machine, a separate reject mechanism is mounted on support bar 10 for each row of segments produced by the slitter mechanism. Each reject mechanism is separately and selectively operable to reject unacceptable segments. Each reject mechanism includes a plurality of reciprocally movable fingers 14 which are spaced from each other across the length of the reject mechanism. Four such fingers 14*a*–14*d* are shown in FIG. 3; although only two or three fingers 14 would also work. The fingers are movable by a piston 16 from a first, out-of-the-way position, at which movement of segments from the slitter mechanism into container C is unimpeded. As described hereinafter, the fingers are movable into a second position (see FIG. 4) in which they deflect unacceptable segments into the reject container.

Piston 16 is secured to an L-shaped piston bracket 18 using a hex nut 20. The bracket has a long bracket leg 18*a* and a short leg 18*b*. Leg 18*b* has an opening sized to received the end of piston 16 from which a reciprocal piston rod 22 extends. This end of the piston is threaded to receive the hex nut. The outer end of rod 22 is threaded, and a clevis 24 is threaded onto this end of the piston rod.

The piston 16/bracket 18 sub-assembly is now secured to a bearing rail 26. Rail 26 is rectangular in plan. A recess 26*a* is formed in an upper surface 28 of the rail at the lower, rear end of the rail as viewed in FIG. 4. Bracket leg 18*a* abuts up against this recessed portion of the rail. Concentric bores (not shown) are formed in the bracket leg and recess for the piston 16/bracket 18 sub-assembly to be secured to the rail by a pin 30 and cap screw 32.

Bearing rail 26 is now secured to an assembly adjustment mount 34. Mount 34 includes an elongate plate section 34*a* and a body section 34*b*. An upper end portion 26*b* of bearing rail 26 abuts against an inner face 36 of mount 34. Concentric bores (not shown) extend through body section 34*b* of mount 34, and extension 26*b* of bearing rail 26. Cap screws 38 are threaded into these bores to attach the bearing rail and mount together.

The sub-assembly now formed by mount 34 and bearing rail 26 are fitted onto a mating surface 40 of a reject assembly mount 42. Mount 42 is generally L-shaped (when viewed in elevation as in FIG. 4). A back wall 42*a* of the reject assembly mount is chamfered to form an angled surface the angle of which corresponds to that of a mating surface of mount 34. This latter angled surface is formed by the angle at which elongate plate section 34*a* extends from body section 34*b* of mount 34. A jack plate 44 is fitted against an outer face of the reject assembly mount. Bores (not shown) extend through the jack plate, the body of the reject assembly mount, and into extension 34*a* of the bearing rail. Screws 46 are used to attach these three components together. In addition, an upright leg portion 42*b* of mount 42 has an inner face 42*c* which angles inwardly as shown in FIG. 4. A mating wall surface of main support 12 is similarly contoured to facilitate attachment of mount 42 to the main support bar. A bore (not shown) extends horizontally through the main support bar and into leg 42*b* of mount 42 for the mount to be attached to the main support bar using screws 47.

The reject fingers 14*a*–14*d* are mounted to a finger support bar 50 using cap screws 52 (FIG. 3) and t-nuts 54 (FIG. 4). As shown in FIG. 4, support bar 50 includes a channel 56 through which the reject fingers slide into a desired position along the length of the assembly. The base of channel 56 is sufficiently wide so to accommodate a head of the t-nuts 54. The upper end of the channel then narrows to accommodate a shank portion of the t-nut. Each reject finger comprises a curved body 58 which is wide at its base, curves upwardly and inwardly as viewed in FIG. 4, and narrows to a point at its upper end. A cavity 60 is formed in the base of each finger, the contour of this cavity conforming to the walls of support bar 50 defining channel 56 so the base of the finger fits over the upper end of support bar 50 in which channel 56 is formed. Each finger 14 slides over channel 56 as the reject fingers are moved into their position as shown in FIG. 3. Each finger has a vertical bore (not shown) and a t-nut is slid through the channel with the finger so to be positioned immediately beneath the bore. A cap screw 52 is inserted through the bore in the finger and threaded onto the t-nut to lock each finger in place. To reposition or remove a finger from mechanism 10, screw 52 is simply loosened which allows the finger to be moved.

As shown in FIG. 4, the lower, base end of finger support bar 50 curves downwardly and outwardly. A raised shoulder 62 extends the length of the base of the support bar. A saddle support 64 has an upper end in which a recess 66 is formed to accommodate shoulder 62 so that the finger support bar and saddle support interfit with one another. These two components are attached to each other using screws (not shown). At the base of the saddle support an extension is formed which comprises a saddle 68. Clevis 24, which is U-shaped, straddles saddle 68 and is attached to the saddle by a pin 69. Movement of piston rod 22 therefore produces a corresponding movement of saddle 68 and saddle support 64.

A bearing saddle 70 is slidably received on extension 26*b* of bearing rail 26 so the bearing rail can guide movement of the reject fingers between their retracted and extended positions. The bearing saddle fits about the upper end portion 26*b* of bearing rail 26 as shown in FIG. 3 for the bearing saddle to move back and forth over the rail. Bearing saddle 70 and saddle support 64 are attached to each other again using screws (not shown). A deflector plate 72 comprises a rectangular plate whose width corresponds to the width of saddle support 64. The length of the deflector plate is such that it extends from the underside of finger support bar 50, as viewed in FIG. 4, along the underside of saddle support 64, and substantially along the length of piston 16. The deflector plate attaches to the saddle support and finger support bar in any convenient manner, for example, with flat head socket cap screws (not shown).

Saddle support 64, finger support bar 50, reject fingers 14, deflector plate 72, and bearing saddle 70, are first assembled together. The resultant sub-assembly is then slid onto bearing rail 26 for subsequent sliding movement along the rail when piston 16 is actuated. In so doing, saddle 68 is aligned with clevis 24 and secured with to the clevis with pin 69. The reject mechanism assembly is now secured to main support bar 12 using screws (not shown) which fit through a slotted channel 74 formed in the main support bar and extending the length of the main support bar. The main support bar allows reject mechanism 10 to be moved into different positions depending upon the size of the segments s being formed by slitter mechanism S. As shown in FIG. 2, several reject mechanisms 10 are mounted on main support bar 12 with the number of reject mechanisms so installed being a function of how many segment are being cut by the slitter mechanism.

In addition to the reject mechanisms which are attached to the main support bar, a guide finger 80, one for each reject mechanism 10, is also attached to the main support bar. Each guide finger comprises a rectangular plate the length of which is such that when main support bar 12 is attached to a frame F of slitter mechanism S (see FIG. 2), the finger provides a path over which acceptable can segments s to be collected in bin C travel. Because of this, the guide finger for each reject mechanism is mounted on the main support bar between or next to fingers 14 of the reject mechanism. This is as shown in FIG. 3. Attachment of the guide fingers to the main support bar is similar to that in which the reject fingers are mounted to finger support bar 50. That is, channel 74 allows the guide fingers 80 to be moved into a desired position along the length of the main support bar. The base of channel 74 is sufficiently wide so to accommodate the head of t-nuts (not shown). The upper end of the channel then narrows to accommodate a shank portion of the t-nut. When the guide finger is in position, a cap screw 82 is inserted through a bore in the guide finger and threaded onto the t-nut to lock the guide finger in place. Once the reject mechanisms and guide fingers are attached to main support bar 12, the main support is attached mounted to frame F of the slitter mechanism in any convenient manner.

In operation, good sheets s (those with no printing or other discernible defects) pass over the guide fingers 80 and fall into collection bin C. When the operator of the machine spots segments which are defective, or if printing defects are discerned prior to the printed blanks B being loaded onto the slitter mechanism, a pre-programmable or operator controlled reject controller 90 supplies an input, via a control line 92, to a pressure control unit (pneumatic actuator) 94. An air hose 96 or the like connects between unit 94 and piston 16. Controller 90 momentarily actuates piston 16 to extend rod 22 by means of unit 94 and air hose 96. This, in turn, extends the reject fingers 14 into the path of the rejected segment s now exiting the slitter mechanism. The reject fingers are extended into the path of the rejected segment by piston 16 causing the assembly comprising bearing saddle 70, saddle support 64, finger support 50, fingers 14, and deflector plate 72 to slide a short distance along bearing rail 26 and so interpose the reject fingers into the path of a segment. The timing of this operation is such that piston 16 retracts rod 22 and the above described assembly before the next segments s is ejected from the slitter mechanism so that if this next segment is acceptable it will move over guide finger 80 and into bin C.

Figure 5:
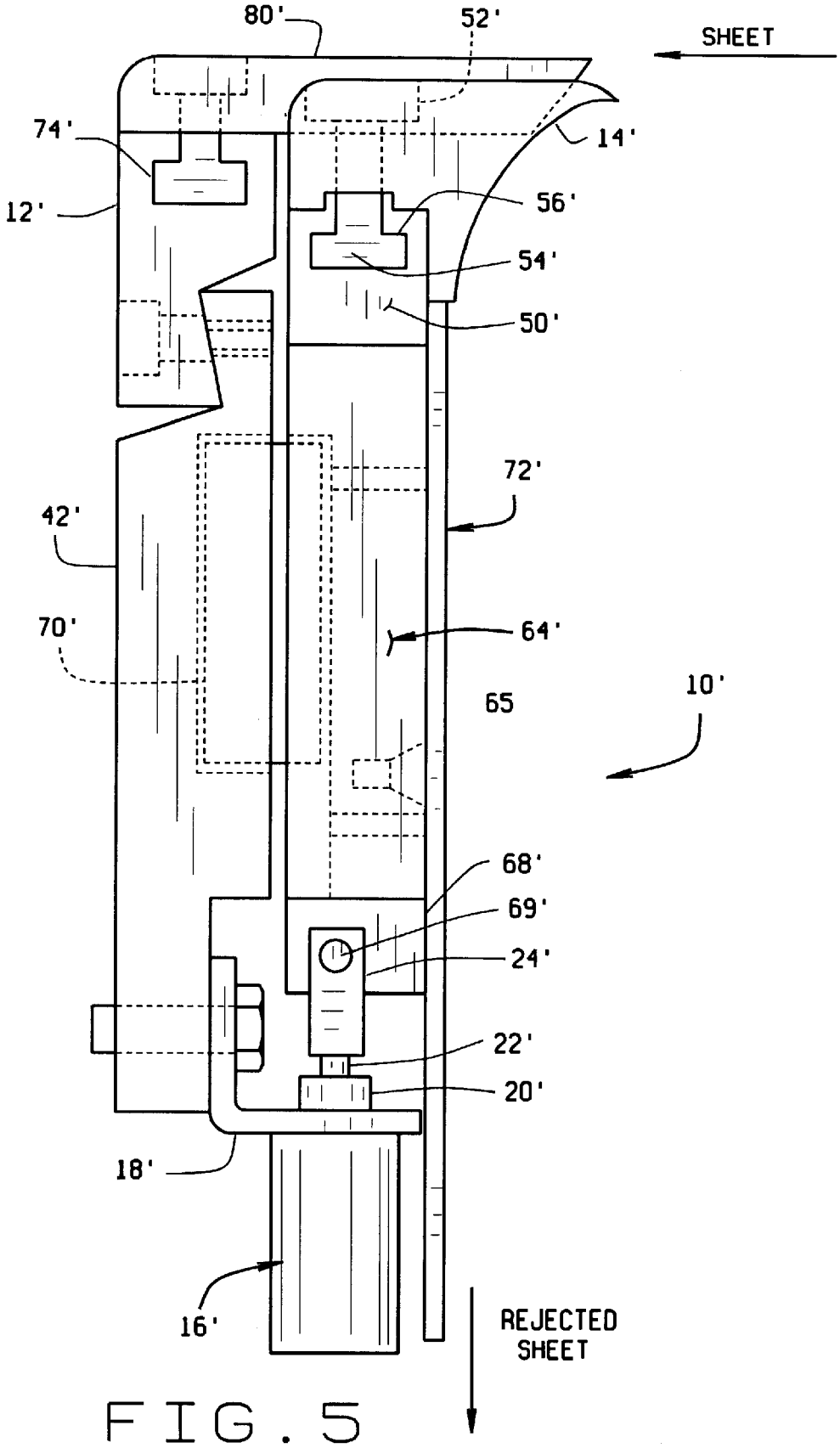

Referring to FIG. 5, a second embodiment of the invention is indicated generally 10'. This embodiment differs from the above described embodiment in that it is designed for use with a different type slitter in which the space available to install 10' is much smaller. As a consequence, rather than having the angled orientation shown in FIG. 4, the embodiment in FIG. 5 is mounted to a support bar 12' so to extend vertically. Embodiment 10' includes a plurality of fingers 14' which, as previously described are spaced from each other across the width of the mechanism. A piston 16' is attached tog a leg **18*b* of an L-shaped bracket 18' by a hex nut 20'. A reciprocal piston rod 22' extends through the hex nut and the outer end of the rod attaches to a clevis 24' by a pin 69'. The clevis attaches to a saddle 68' of a saddle support 64'**.

What has been described is a reject mechanism for use with a conventional slitter mechanism to selectively remove an unwanted sheet segment from a stream of such segments produced by the slitter mechanism. The reject apparatus is operable by the operator of the slitter and includes a plurality of reject fingers spaced across the outlet end of the slitter mechanism to selectively remove unwanted segments. The reject mechanism operates to quickly and efficiently remove the unwanted segments while not interfering with the throughput rate of the slitter. The mechanism is readily installed and removed and can be used either as original equipment or as a retrofit installation. The mechanism can be employed with most conventional slitters so to provide a low cost enhancement to this equipment.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. In a container forming operation in which a sheet is run through a slitter mechanism which cuts the sheet into a plurality of segments each of which is used to make a container, the improvement comprising a reject mechanism used in conjunction with the slitter mechanism for rejecting unacceptable segments so a container will not be made therefrom, the reject mechanism comprising:

support means attached to a frame of the slitter mechanism at an output end thereof;

at least one reject finger movable from a retracted position to an extended position, the reject finger in its extended position blocking a path over which segments leaving the slitter mechanism travel so to divert unacceptable segments away from the path;

a piston operatively connected to said reject finger to move said reject finger between its retracted and extended positions when said piston is actuated; and, guide means for guiding movement of said reject finger between its positions, said guide means being attached to said support means to position said reject finger adjacent the path over which segments travel from the slitter mechanism so said reject finger is extended into said path when said piston is actuated.

2. The improvement of claim 1 further including a plurality of reject fingers and a finger support bar for mounting the fingers in a spaced relationship to each other so the fingers extend across the path of a segment when extended.

3. The improvement of claim 2 wherein the piston includes an extensible and retractable rod and the reject mechanism further includes a saddle means attached to one end of the rod and to the finger support bar to move the reject fingers in response to movement of said rod by said piston.

4. The improvement of claim 3 wherein said guide means includes a bearing rail and said saddle means includes a saddle bearing slidably received on said bearing rail for the bearing rail to guide reciprocal movement of said reject fingers between their retracted and extended positions.

5. The improvement of claim 4 further including means for adjusting the position of the reject fingers relative to the path.

6. The improvement of claim 2 further including a guide finger attached to said support means and providing the path for the segments moving from the slitter mechanism.

7. The improvement of claim 6 wherein the guide finger is positioned on the support means intermediate adjacent reject fingers.

8. The improvement of claim 7 wherein said support means comprises a support bar attached to the frame.

9. The improvement of claim 1 further including a plurality of reject mechanisms mounted to the support means in a side-by-side arrangement.

10. The improvement of claim 1 further including a controller from controlling actuation of the piston to move the reject finger to its extended position.

11. The improvement of claim 10 wherein said controller is operable by an operator of the slitter mechanism in order to selectively reject unacceptable segments.

12. The improvement of claim 11 wherein said controller is programmable to reject certain segments produced by the slitter mechanism.

13. A reject mechanism for use in rejecting container segments formed by a slitter mechanism to which the reject mechanism is attached, the slitter mechanism cutting a printed blank into a plurality of segments each of which is used to make a container:

a support bar attached to a frame of the slitter mechanism at an output end thereof from which container segments are ejected;

a plurality of reject fingers and a finger support bar on which the reject fingers are mounted in a spaced relationship, the reject fingers being simultaneously movable from a retracted position to an extended position in which the reject fingers block a path over which segments leaving the slitter mechanism travel so to divert unacceptable segments away from the path;

a piston to which said finger support bar is connected for moving said reject fingers from their retracted to their extended position when said piston is actuated;

saddle means by which said piston is connected to said finger support bar; and, guide means over which said saddle means is movable for guiding movement of said reject fingers between their positions, said guide means being attached to said support bar to position said reject fingers adjacent the path over which segments travel from the slitter mechanism so said reject fingers are extended into the path when said piston is actuated.

14. The reject mechanism of claim 13 wherein the piston includes an extensible and retractable rod one end of which is attached to said saddle means attached to move the reject fingers in response to movement of said rod by said piston.

15. The reject mechanism of claim 14 wherein said guide means includes a bearing rail and said saddle means includes a saddle bearing slidably received on said bearing rail for the bearing rail to guide reciprocal movement of said reject fingers between their retracted and extended positions.

16. The reject mechanism of claim 15 further including a guide finger attached to said support bar and providing the path for the segments moving from the slitter mechanism, said guide finger being positioned on said support bar intermediate adjacent reject fingers.

17. The reject mechanism of claim 16 further including a controller controlling actuation of the piston to move the reject fingers to their extended position, said controller being operable by an operator of the slitter mechanism in order to selectively reject unacceptable segments, or said controller being programmable to reject certain segments produced by the slitter mechanism.

* * * * *